US006340288B1

(12) United States Patent
Hulkkonen et al.

(10) Patent No.: US 6,340,288 B1
(45) Date of Patent: Jan. 22, 2002

(54) HIGH-PRESSURE FAN

(75) Inventors: Rauli T Hulkkonen, Espoo; Jyri-Markku Vuorenmaa, Helsinki; Joni A Tallgren, Klaukkala, all of (FI)

(73) Assignee: ABB Flakt Oy, Espoo (FI)

( * ) Notice: Subject to any disclaimer, the term of this patent is extended or adjusted under 35 U.S.C. 154(b) by 0 days.

(21) Appl. No.: 09/341,107

(22) PCT Filed: Jan. 16, 1998

(86) PCT No.: PCT/FI98/00037

§ 371 Date: Jul. 2, 1999

§ 102(e) Date: Jul. 2, 1999

(87) PCT Pub. No.: WO98/31937

PCT Pub. Date: Jul. 23, 1998

(30) Foreign Application Priority Data

Jan. 17, 1997 (FI) ..... 970210

(51) Int. Cl.[7] ..... F04D 29/44

(52) U.S. Cl. ..... 415/199.1; 415/200; 416/241 A

(58) Field of Search ..... 415/99, 100, 101, 415/102, 103, 199.1, 200; 416/230, 241 A; 417/244, 350, 423.5

(56) References Cited

U.S. PATENT DOCUMENTS

| | | | | |
|---|---|---|---|---|
| 1,014,321 A | | 1/1912 | Minor | |
| 1,404,849 A | | 1/1922 | Hamilton | |
| 1,406,600 A | | 2/1922 | Zahm | |
| 1,842,178 A | | 1/1932 | Kempton | |
| 1,985,705 A | | 12/1934 | Whiton, Jr. | |
| 2,903,182 A | | 9/1959 | Downs | |
| 3,602,608 A | | 8/1971 | Morley | |
| 3,915,596 A | | 10/1975 | Frazar | |
| 4,523,896 A | * | 6/1985 | Lhenry et al. | 417/244 |
| 4,676,722 A | | 6/1987 | Marchal et al. | |
| 4,746,266 A | | 5/1988 | Kirchner et al. | |
| 4,808,055 A | | 2/1989 | Wertz et al. | |
| 4,895,491 A | | 1/1990 | Cross et al. | |
| 5,104,293 A | | 4/1992 | Eaton, Jr. et al. | |
| 5,464,325 A | | 11/1995 | Albring et al. | |
| 5,520,008 A | * | 5/1996 | Ophir et al. | 416/230 |
| 5,538,395 A | | 7/1996 | Hager | |
| 5,599,169 A | | 2/1997 | Hauser | |
| 5,632,601 A | * | 5/1997 | Bodmer et al. | 416/223 B |
| 5,775,878 A | | 7/1998 | Maumus et al. | |
| 5,800,128 A | | 9/1998 | Bodmer et al. | |
| 5,845,398 A | | 12/1998 | Maumus et al. | |

FOREIGN PATENT DOCUMENTS

| | | | |
|---|---|---|---|
| GB | 920188 C | 6/1963 | |
| JP | 59-34499 | 2/1984 | |
| JP | 59-200093 | * 11/1984 | 415/99 |

OTHER PUBLICATIONS

Patent Abstracts of Japn, vol. 13, No. 373, M–861 abstract of JP 1–125596 A (Kubota Ltd.), May 18, 1989.

* cited by examiner

*Primary Examiner*—Edward K. Look
*Assistant Examiner*—Ninh Nguyen
(74) *Attorney, Agent, or Firm*—Nixon & Vanderhye P.C.

(57) ABSTRACT

A high-pressure fan comprising a blade wheel (3, 4), a fan housing (5, 6) surrounding the blade wheel and an electric motor (1) to operate the blade wheel. To eliminate the problems related to the mounting of the blade wheel, the blade wheel (3, 4) at least mainly consists of light carbon fiber based composite material and is directly mounted on the shaft (2) of the electric motor.

4 Claims, 1 Drawing Sheet

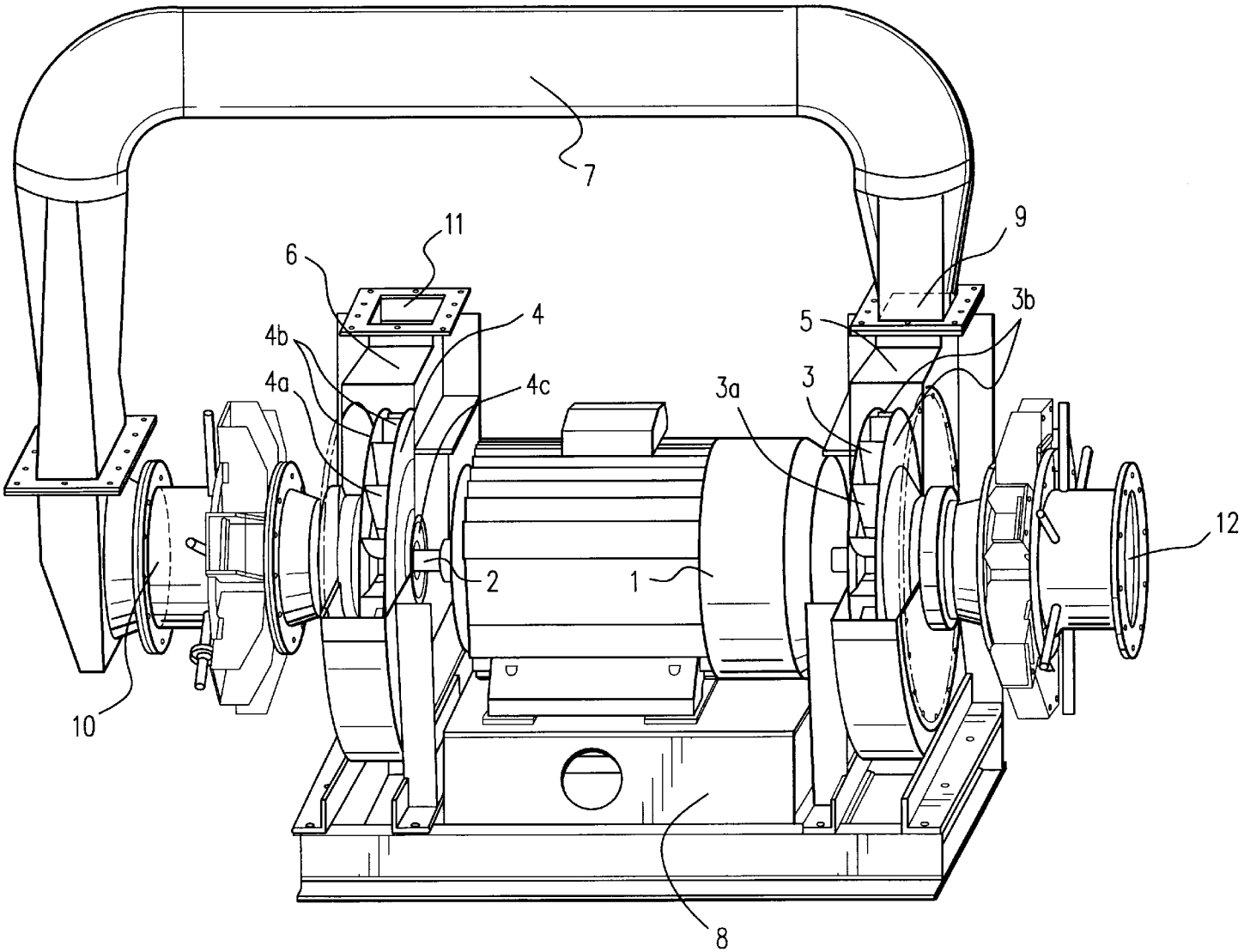
12
9
3b
5
3
3a
1
8
7
4
4c
2
11
6
4b
4a
10

HIGH-PRESSURE FAN

TECHNICAL FIELD

The invention relates to a high-pressure fan comprising a blade wheel, a fan housing surrounding the blade wheel and an electric motor to operate the blade wheel.

BACKGROUND

With a high-pressure fan implemented according to the prior art, having a blade wheel of steel blades with separate roller bearings, it is at best possible to achieve a pressure rise of a few dozens of kPas at one stage. When the prior art technology is applied, the high-pressure fan has to be implemented as a two-staged or multi-staged series-connected arrangement if a higher rise in the pressure is to be achieved.

The determining factor in the mechanical implementation of the high-pressure fan of the prior art is the weight and strength of the steel blade wheel. Because of the heavy blade wheel, compromises have to be made as regards the dimensioning of bearings. The bearings must endure the great stress put on them by the weight of the blade wheel, and also sustain the centrifugal forces resulting from the high rotation speed and heat production in the roller elements. For the fan to operate smoothly, the critical rotation speed of the rotor system has to be above the operating rotation speed. In practice, this results in such dimensioning in which the roller bearings used are relatively large, and the heat generated in the bearings is led away by means of an effective oil circulation lubricating system.

Due to the above-mentioned features, both the single-staged and multi-staged versions of the existing high-pressure fans have to be provided with separate bearings, either roller or slide bearings, since the bearings of the electric motor do not endure the stress caused by a steel blade wheel.

SUMMARY OF THE INVENTION

An object of the present invention is to eliminate the drawbacks described above. This is achieved with a high-pressure fan of the invention, characterized in that the blade wheel at least mainly consists of carbon-fibre-based composite material, and is mounted directly on the shaft of the electric motor.

By making the blade wheel of a high-pressure fan or its essential components of carbon-fibre-based composite material, the weight of the blade wheel can be reduced to a fraction of the weight of a steel blade wheel. A blade wheel made of this material can be dimensioned to be as strong as the steel blade wheel or even stronger. The light composite blade wheel can be mounted directly on the shaft of a standard electric motor without the stress on the bearings increasing too high. By means of an AC inverter, a fan implemented in this way can be rotated up to the maximum rotation speed given by the manufacturer of the bearings.

When an electric motor is preferably implemented with a shaft going through it, and a blade wheel of composite material is mounted on the shaft of the motor at its both ends, the axial forces generated in the blade wheels will cancel each other out, and hence it will be possible to use the standard bearings of the electric motor. The sides of the fan implemented in this way can be interconnected with an intermediate channel, i.e. it is possible to provide a two-staged fan which replaces the conventional version implemented with two separate fans. The fan arrangement can naturally be used as two separate series-connected fans without the above-mentioned intermediate channel.

Compared with the conventional two-staged fan implemented with two separate fans, the two-ended fan of the present invention allows to dispose of 4 bearings with their casings and circulation lubricating units as well as of couplings between the electric motor and the blade wheel arrangement since no separate bearings are needed. Furthermore, the arrangement is compact, a simple and cheap steel bed can be used, and no multilevel bed arrangements are needed in the installation.

In the following, the invention will be described by means of one preferred embodiment with reference to the accompanying drawing,

BRIEF DESCRIPTION OF THE DRAWINGS

The single FIGURE is a perspective view of a high pressure fan in accordance with an exemplary embodiment of the invention.

DETAILED DESCRIPTION OF THE DRAWINGS

The high-pressure fan illustrated in the drawing has as its source of motive power an electric motor 1, comprising a rotor shaft 2 going through it, i.e. a shaft the ends of which project at both sides of the motor 1. A light blade wheel 3 and 4, which at least mainly consists of carbon-fibre-based composite material, i.e. at least its blades 3*a*, 4*a* and end plates 3*b*, 4*b* are of said material, is mounted directly onto the both ends of this shaft without separate bearings. The hub 4*c* of the blade wheel may also be of some other material, e.g. steel. This direct mounting means that only the bearings of the electric motor 1 are used for mounting the whole above-mentioned arrangement. The blade wheels 3 and 4 are surrounded by fan housings 5 and 6, and the pressure opening 10 of the first housing 5 is connected to the suction opening 9 of the second housing 6 with an intermediate channel 7.

Reference number 11 denotes the pressure opening of the second housing 6, and reference number 12 the suction opening of the first housing. The view of the housings 5 and 6 illustrated in the drawing is partially sectional. The whole fan arrangement described above is placed on a simple steel bed 8.

Due to the connecting intermediate channel 7 the fan illustrated in the drawing functions as a two-staged fan. If this intermediate channel 7 is removed, the fan arrangement will function as two separate series-connected fans.

The invention has been described above only by means of one preferred embodiment. One skilled in the art can, however, implement the fan of the invention and its details in several alternative ways within the scope of the appended claims. For example, there could be a blade wheel only at one end of the motor, and the axle could be implemented in such a way that it does not go through the motor. Correspondingly, there could be several blade wheels at both ends of the motor or only at one end of it.

What is claimed is:

1. A high-pressure fan comprising a blade wheel, a first fan housing surrounding the blade wheel, and an electric motor to operate the blade wheel, said electric motor having a shaft projecting from one end thereof, and wherein said blade wheel substantially consists of carbon-fibre-based composite material, and is mounted directly, without additional bearings, on said one end of the shaft.

2. A high-pressure fan as claimed in claim 1, wherein the shaft extends through the electric motor, projecting also from an opposite end of the electric motor with a second blade wheel mounted directly, without additional bearings, on said opposite end of said shaft.

3. A high-pressure fan as claimed in claim 2, wherein a second fan housing surrounds the second blade wheel, said first and second fan housings interconnected by an intermediate channel.

4. A high-pressure fan as claimed in claim 3, wherein said intermediate channel leads from a pressure opening of one of the housings to a suction opening of the other housing.

* * * * *